US006216576B1

(12) United States Patent
Ohtani et al.

(10) Patent No.: US 6,216,576 B1
(45) Date of Patent: Apr. 17, 2001

(54) PLOTTERS

(75) Inventors: Katsuhiko Ohtani; Takeshi Kishimura, both of Tokyo (JP)

(73) Assignee: Mutoh Industries Ltd., Tokyo (JP)

( * ) Notice: Subject to any disclaimer, the term of this patent is extended or adjusted under 35 U.S.C. 154(b) by 0 days.

(21) Appl. No.: 09/397,925

(22) Filed: Sep. 17, 1999

(30) Foreign Application Priority Data

Sep. 18, 1998 (JP) ..... 10-265154

(51) Int. Cl.[7] ..... B26D 5/08
(52) U.S. Cl. ..... 83/576; 83/577; 83/556
(58) Field of Search ..... 83/576, 577, 556

(56) References Cited

U.S. PATENT DOCUMENTS 3,593,426 * 7/1971 Gomagalski ..... 33/18
4,884,224 * 11/1989 Hirosawa ..... 364/550
5,074,178 * 12/1991 Shetley et al. ..... 83/371
5,163,759 * 11/1992 Jambor et al. ..... 400/29
5,262,617 * 11/1993 Higashiguchi ..... 83/575
5,321,892 * 6/1994 Sasada ..... 83/614
5,479,585 * 12/1995 Komagine ..... 395/103

* cited by examiner

*Primary Examiner*—M. Rachuba
(74) *Attorney, Agent, or Firm*—Sughrue, Mion, Zinn, Macpeak & Seas, PLLC

(57) ABSTRACT

An object of this invention is to provide a simple construction for preventing a collision of the cutter with the surface of paper at a high speed, and the construction provides a controller 20 that minimizes the impression voltage to a cutter drive actuator 38 in the first stage and gradually increases by stages thereafter. After the impression voltage for descending of the cutter to the cutter drive actuator 38 arrives at a maximum set voltage, the controller 20 switches the impression voltage for the cutter drive actuator 38 to the predetermined voltage for cut, and thereafter, the cut operation proceeds.

15 Claims, 5 Drawing Sheets host CPU
48
interface
46
controller
20
drawing head
18
paper carrier motor
16
carrier drive motor
8
cutter drive actuator
38

PLOTTERS

BACKGROUND OF THE INVENTION

The present invention relates to a plotter provided with a cutting head, and a cutter drive actuator is driven to lower a cutter, and the cutting head transfers in a horizontal direction relative to a paper to cut the paper on the cutting surface.

In a pen plotter that moves a pen vertically by means of a moving coil, in order to prevent a collision of the pen against a plotting, impressed voltage to the moving coil is controlled by a closed field system on the basis of a soft landing program, and. the soft landing of the pen is carried out against the plotting surface which has heretofore been known among those who are in the art.

Furthermore, in a plotter wherein a cutter is coupled with a solenoid, an open loop-type plotter has been known in which voltage sufficient to lower the cutter at a high speed is supplied to the solenoid, and after the cutter is collided with the cutter surface, the impressed voltage is lowered to switch to a predetermined cut voltage.

A mechanism of soft landing of the pen by the closed loop system had problems such as complicated control and numerous component parts as well as an expensive cost in case this mechanism is employed in a cutter mechanism. Moreover, a system of down controlling of the cutter by means of the open loop through the solenoid tends to cause a collision of the cutter against the paper surface at a high speed depending on the cutter mechanism on grounds of a fluctuation in the load of the cutter mechanism. For example, assuming that a fluctuation in the load of the cutter mechanism exists between 100 g to 450 g, the voltage that renders the down force sufficiently to the solenoid against the load of 500 g, but in this case, for the cutter mechanism with the load of 100 g or with the load of 200 g, the cutter down force becomes excessive, and as a result, the cutter tends to collide with the cutter receiving surface at a high speed, which causes wear and tear on the part of the cutter which was some of the problems. Furthermore, when the cutter is collided with the cutter receiving surface, a large vibrating force occurs on the machine of the plotter, which exerts an adverse influence on the shape of ink on the nozzle surface of an inkjet recording head, which was resulted in a deteriorated quality of picture in some cases.

The present invention has an object of providing a plotter that has solved the foregoing problems.

SUMMARY OF THE INVENTION

The present invention prevents the collision of the cutter against the surface of the paper at a high speed. When the cutter is lowered in order to cut the paper off, the controller initially minimizes the impressed voltage to the cutter drive actuator and impresses the voltage by stages thereafter. After the impressed voltage for lowering the cutter to the cutter drive actuator arrives at a maximum set voltage, the controller switches the voltage impressed to the cutter drive actuator to a predetermined voltage for cut.

DETAILED DESCRIPTION OF THE INVENTION:

The mode of the embodiment of the present invention will be set forth in the following by referring to attached drawings.

Figure 2:
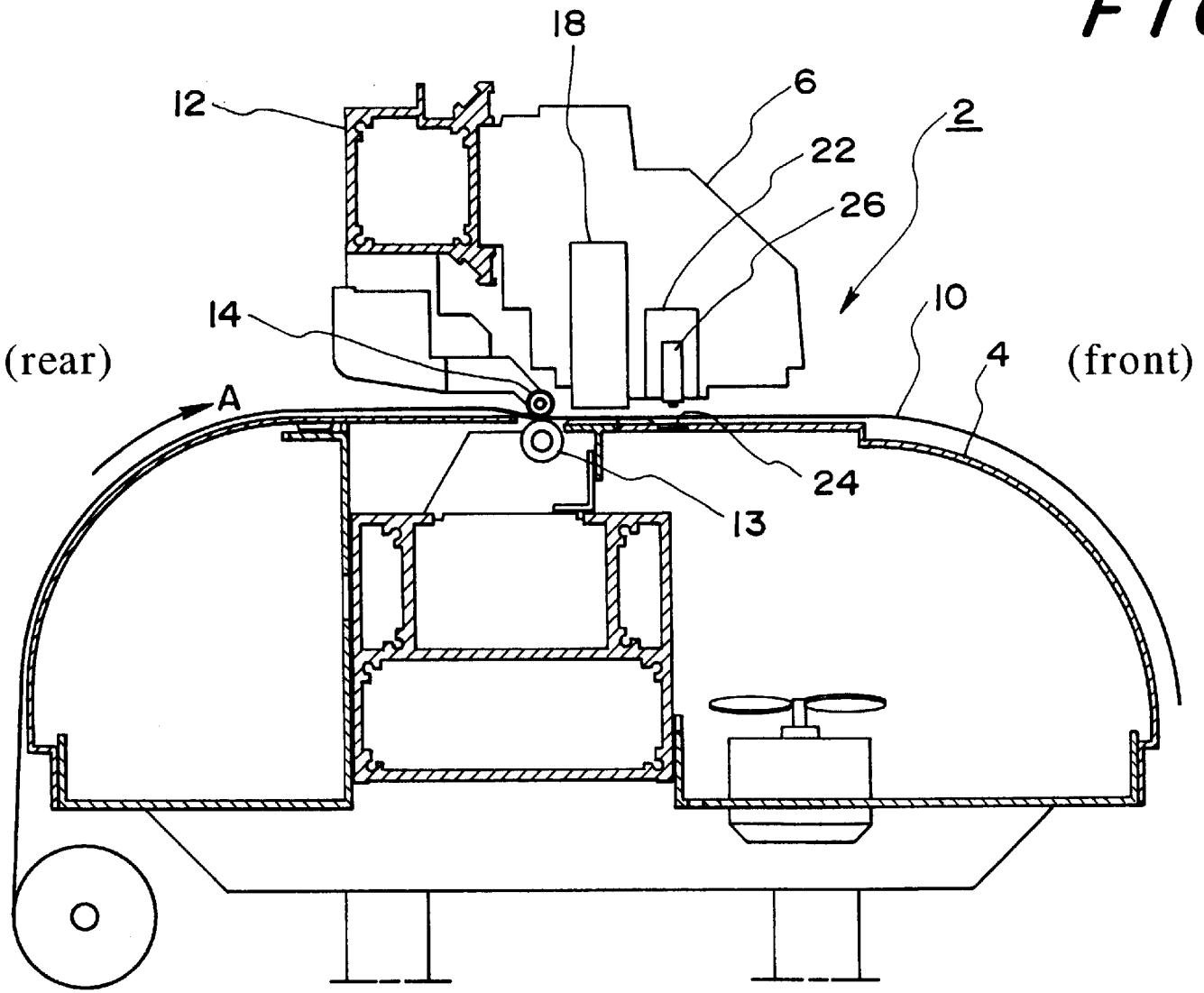
FIG. 2 is a schematic cross sectional view of the plotter.
Figure 3:
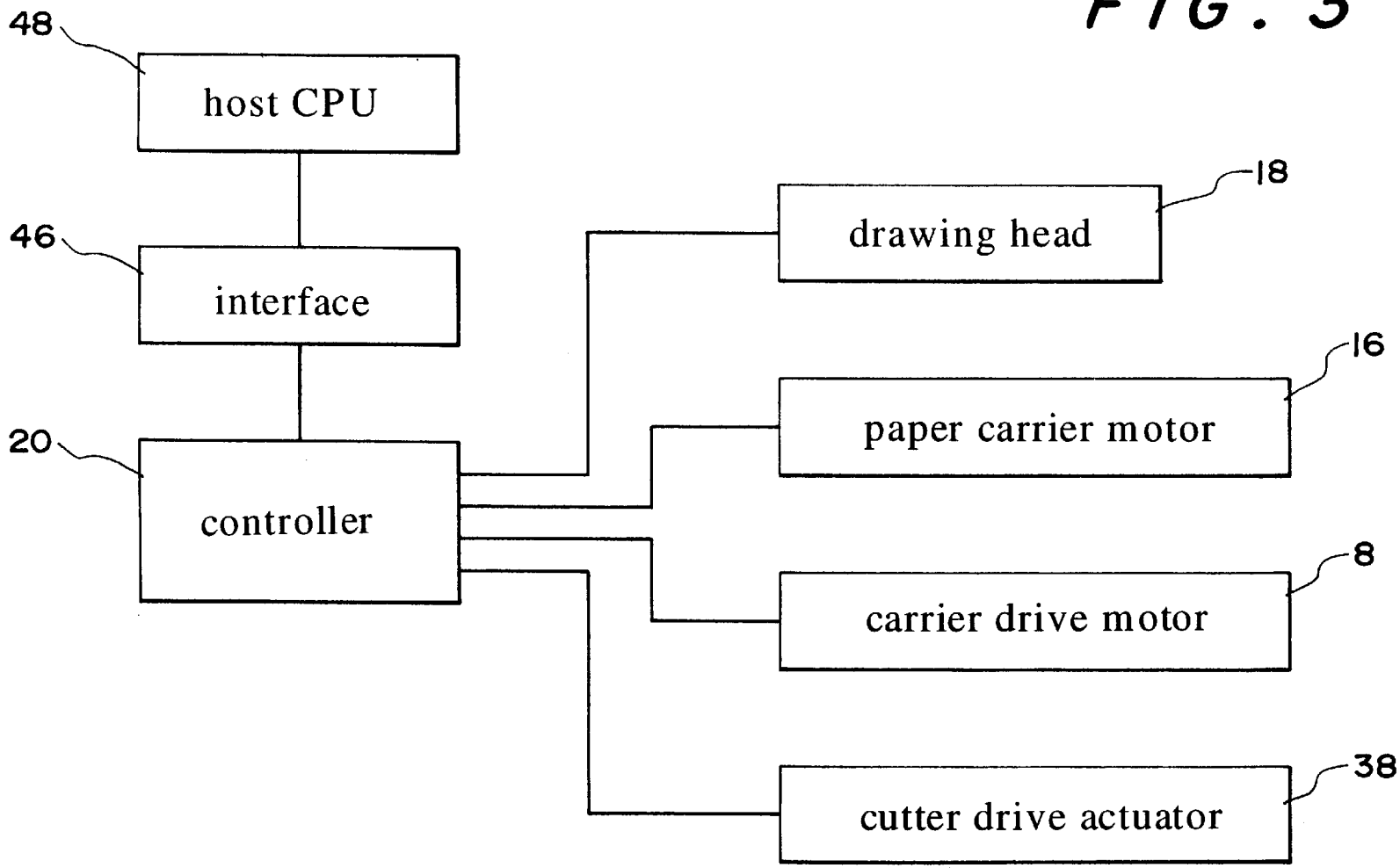
FIG. 3 is a block explanation view of the plotter.
Figure 4:
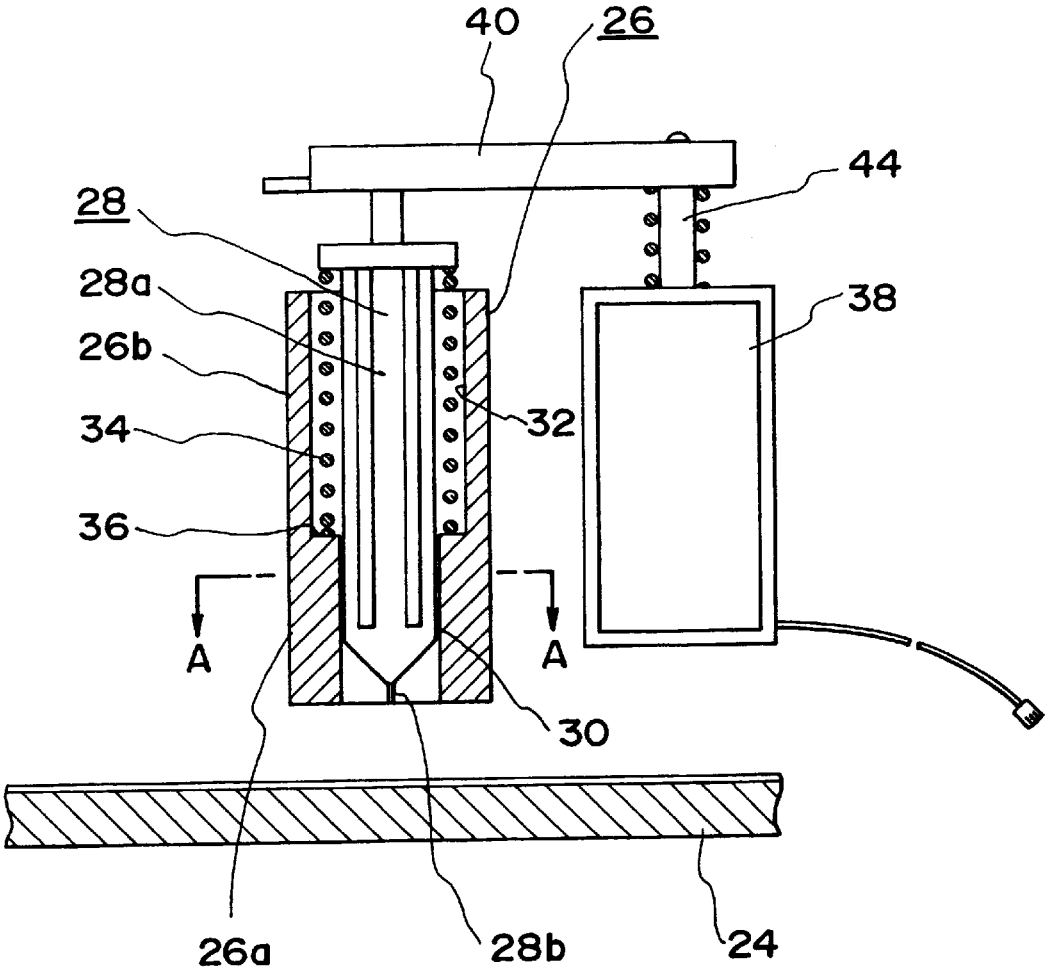
FIG. 4 is a cross section explanation view showing a cutter mechanism of the plotter.
Figure 5:
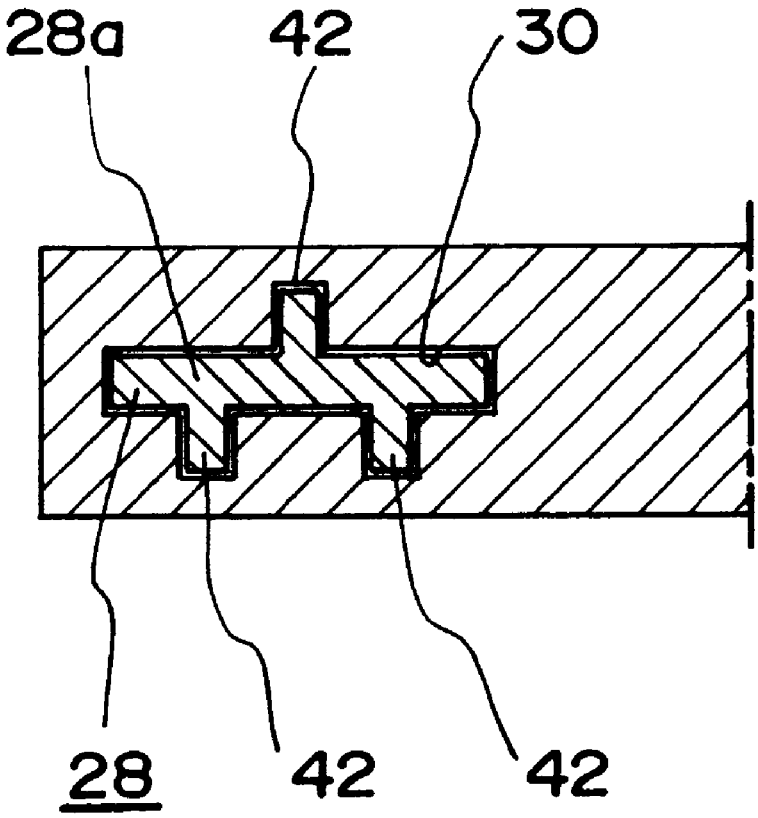
FIG. 5 is an A-A cross section.

Reference numeral 2 denotes a plotter of an inkjet type, and a Y rail 12 is mounted on a platen 4. A carrier 6 is mounted on the Y rail 12 reciprocatingly along the Y rail 12 in a direction crossing a paper 10 on the platen 4, namely, in a paper surface perpendicular direction in FIG. 2 by the drive of a carrier drive motor 8. The paper 10 on the platen 4 is sandwiched between a drive roller 13 and a pressure roller 14, and is carried in a direction of an arrow A in FIG. 2 on the platen 4 by an intermittent rotation of the drive roller 13 to be driven by a paper carrier motor 16. A recording head 18 of inkjet type is mounted on the carrier 6, and the. recording head 18 jets an ink droplet to the paper 10 on the platen 4 on the basis of a picture printing information to be supplied from a controller 20 of the plotter 2, and performs a plotting on the paper 10. Furthermore, a cutting head 22 is mounted on the carrier 6, and the cutting head 22 is constructed in such a way that a predetermined position of the paper 10 that is already plotted is cut off by the transfer of the carrier 6 in a direction crossing the paper 10, namely, Y axis direction on the cutting surface of a cutting mat 24 fixed to the platen 4. A cylindrical cutter guide holder 26 is integrally fixed to the machine body of the cutting head 22 as shown in FIG. 4, and a cutter 28 is inserted and disposed liftably in the cutter.guide holder 26 in a perpendicular direction against the cutting mat 24. The cutter 28 comprises a thin plate resin portion 28*a* formed by a resin molding and a blade portion 28*a* made of metal blade, and a part of the cutter 28 is slidably fitted with a friction into a guide hole 30 of rectangular cross section of an angular cylindrical guide portion 26*a* of the cutter guide holder 26. On the upper part of the cutter guide holder 26, the cylindrical holder portion 26*a*,is formed, and on the holder portion 26*b*, a holder hole 32 of circular cross section is formed which is coaxial with the guide hole 30, and a part of the cutter 28 is loosely disposed in the holder hole 32. The cutter 28 is energized in a lifting direction with a lower end 36 of different level of the holder hole 32 as a fulcrum by a resilient force of a coil spring 34 compressed and disposed in the holder hole 32, and an upper end of the cutter 28 is disposed in contact with the lower surface of an arm 40 connected to the cutter drive actuator 38 such as the solenoid and the like. A convex stripe 42 is formed on the resin portion 28*a* of the cutter 28 along its longitudinal direction, and the convex stripe 42 is fitted to a concave groove of the guide hole 30, and thus, the cutter 28 is guided accurately along the guide hole 30. The cutter resin portion 28*a* is curved, and a friction arises between the guide hole 30 and the cutter resin portion 28*a* by the curve. This friction force constitutes a load against the descendance of the cutter 28 by the cutter drive actuator 38. When the voltage is impressed to the cutter drive actuator 38 by instruction from the controller 20, and the coil is energized, an output shaft 44 is attracted to descend, and the arm is lowered. With the descendance, the cutter 28 is forced to lower by resisting the resilient force of the spring 34, and the blade 28*a* of the tip of the cutter 28 comes to contact the cutting mat 24 under pressure with a predetermined pressure. In the pressure contact condition, when the carrier 6 transfers in the Y-axis direction along the Y rail 12, the paper 10 on the cutting mat 24 is cut off by the cutter 2. When the supply of voltage to the cutter drive actuator 38 is released, the cutter 28 rises by the resilient force of the coil spring 34,and lifts by a predetermined distance from the cutting mat 24. The controller 20 prepares a plotter drive signal on the basis of a picture signal from a host computer 48 connected by means of an interface 46, and a picture data is supplied to the recording head 18, and controls the motors 8, 16 and the actuator 38.

In the following, the down control of the cutter by the controller will be described by referring to FIG. 1.

Figure 1:
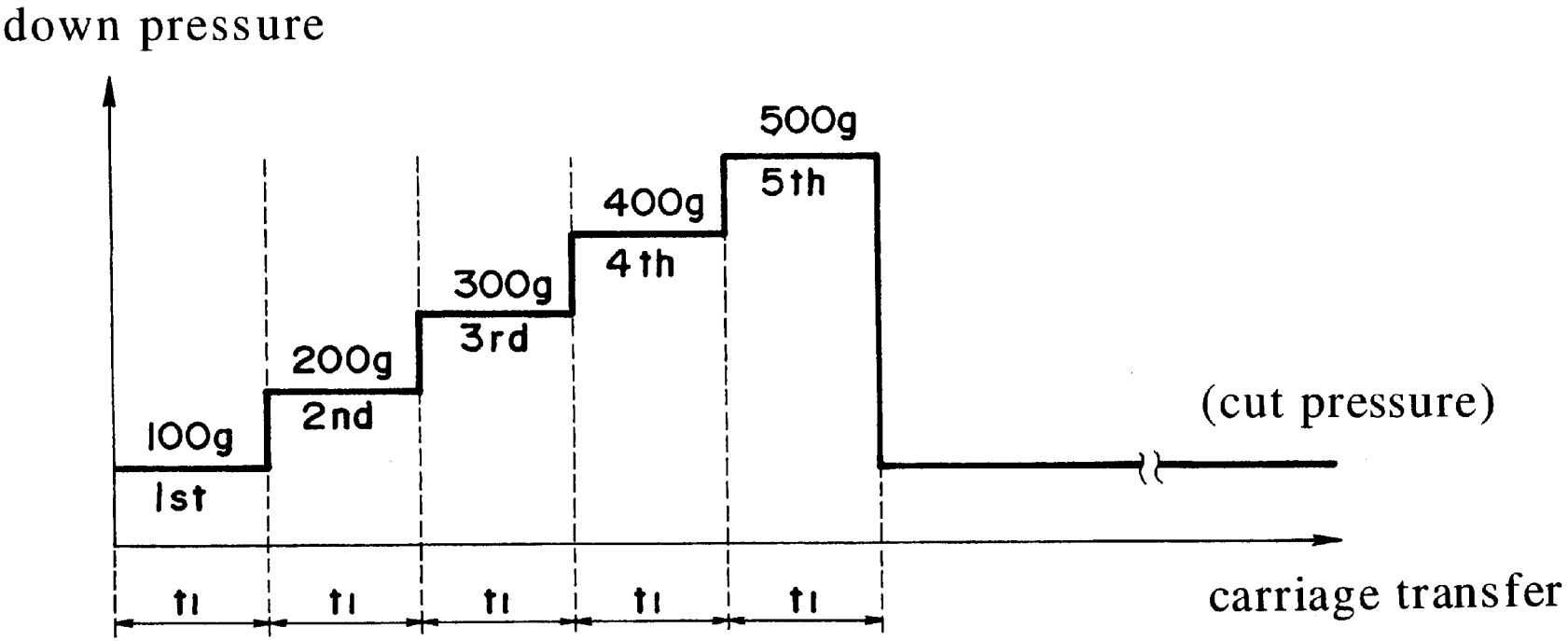
FIG. 1 is an operation explanation drawing of the present invention.

FIG. 1 shows an example where the descending force of the cutter drive actuator 38 is 500 g(operation rate 100%) and the load of the cutter mechanism is set at from 100 g to 450 g. The load of the cutter mechanism means concretely and primarily the friction force between the cutter 28 and the cutter guide holder 26, and assumption is based on a fluctuation between 100 g and 450 g by the cutter mechanism of the plotter. The voltage for cutter down to be supplied to the cutter drive actuator 38 by the instruction from the controller 20 is set at 5 stages as shown in the following.

First stage: voltage (1st voltage) corresponding to cutter down force of 100 g

Second stage: voltage (2nd voltage) corresponding to cutter down force of 200 g

Third stage: voltage (3rd voltage) corresponding to cutter down force of 300 g

Fourth stage: voltage (4th voltage) corresponding to cutter down force of 400 g

Fifth stage: voltage (5th voltage) corresponding to cutter down force of 500 g

The voltage impressing time t1 of each stage is set at a time required to down the counter 28 from the lifting position from the standpoint of mechanism.

The voltage signal of 5 stages is transmitted from the first stage to the fifth stage sequentially to the cutter drive actuator 38 at the cutter down time by the control of the controller 20.In the case where the cutter mechanism of the plotter is load 100 g, the cutter 28 downs with the [1st voltage]of the first stage. Furthermore, in the case where the cutter mechanism of load 250 g, the cutter (28) downs with [3rd voltage] of the third stage. Moreover, in the case of the cutter mechanism of load 450 g, the cutter 28 downs with[5th voltage] of the fifth stage.

The controller 20 switches to the cutter voltage applying signal for cutting the paper at a time of elapse of 5t 1 hours upon impression of the voltage for the descendance of the cutter,and sets the pressure of the cutter 28 against the cutting surface to a predetermined paper cut pressure. And, the cutting head 22 transfers in the Y axis direction along the cutting surface by the transfer of the carrier 6, and the cut operation of the paper 10 is carried out.

The present invention has been constructed as explained in the foregoing, and therefore, has an effect of preventing the collision of the cutter with the surface of the paper at a high speed by a simple construction.

What is claimed is:

1. A plotter wherein a cutting head adapted for movement in a horizontal direction across a paper is provided, and a cutter is descended by driving a cutter drive actuator, and the cutting head transfers in the horizontal direction against the paper to cut the paper on a cutting surface, an improved plotter wherein an impressed voltage to the cutter drive actuator is small initially at a cutter descending time, and the impressed voltage is increased by stages gradually after an elapse of a predetermined time for each stage, and after reaching a maximum impressed voltage, the impressed voltage is switched to a predetermined impressed voltage for cutting.

2. A plotter as claimed in claim 1 wherein the cutter drive actuator is a solenoid.

3. The plotter as claimed in claim 1, wherein the impressed voltage to the cutter drive actuator is increased by at least three stages before reaching the maximum impressed voltage.

4. The plotter as claimed in claim 1, wherein the elapsed predetermined time for each stage is the same.

5. The plotter as claimed in claim 1, wherein the impressed voltage is increased by stages in accordance with a step function.

6. A plotter for plotting images on a paper, comprising:

a cutter having a cutting head, the cutter adapted for movement across the paper and for vertical movement towards and away from the paper;

a cutter drive actuator that vertically moves the cutter towards and away from the paper in accordance with a variable input drive voltage; and a controller that controls said variable input drive voltage; and wherein, said controller is adapted to increase said variable input drive voltage in stages from an initial low value to begin a downward movement of said cutter towards the paper to a maximum value.

7. The plotter according to claim 6, wherein, each of said stages lasts a predetermined period of time.

8. The plotter according to claim 7, wherein, after said variable input drive voltage reaches said maximum value, said controller sets said variable input drive voltage to a cutting voltage value that is different from said maximum value.

9. The plotter according to claim 8, wherein said cutting voltage value is less than said maximum value.

10. The plotter according to claim 7, wherein said variable input drive voltage is increased by at least three stages sequentially before reaching said maximum value.

11. The plotter according to claim 7, wherein the predetermined time for each stage is the same.

12. The plotter according to claim 7, wherein said variable input drive voltage is increased in stages in accordance with a step function.

13. The plotter according to claim 6, wherein said cutter drive actuator is a solenoid.

14. The plotter according to claim 6, wherein said cutter is adapted to cut the paper by being transferred across the paper while continuously being in contact with the paper.

15. The plotter according to claim 1, wherein said cutter is adapted to cut the paper by being transferred across the paper while continuously being in contact with the paper.

* * * * *